US007464646B2

(12) United States Patent
Stettner

(10) Patent No.: US 7,464,646 B2
(45) Date of Patent: Dec. 16, 2008

(54) METHOD FOR PROCESSING LENTICULAR FOIL

(75) Inventor: Gerd Stettner, Coswig (DE)

(73) Assignee: Koenig & Bauer AG, Radebeul (DE)

( * ) Notice: Subject to any disclaimer, the term of this patent is extended or adjusted under 35 U.S.C. 154(b) by 332 days.

(21) Appl. No.: 11/285,688

(22) Filed: Nov. 22, 2005

(65) Prior Publication Data

US 2006/0169156 A1 Aug. 3, 2006

(30) Foreign Application Priority Data

Dec. 1, 2004 (DE) ..... 10 2004 057 844

(51) Int. Cl.
*B41L 3/08* (2006.01)

(52) U.S. Cl. ..... 101/486; 101/217; 101/232; 101/484

(58) Field of Classification Search ..... 101/216, 101/217, 218, 232, 483, 484, 485, 486
See application file for complete search history.

(56) References Cited

U.S. PATENT DOCUMENTS

| | | | | |
|---|---|---|---|---|
| 4,892,336 | A | 1/1990 | Kaule et al. | |
| 5,424,553 | A | 6/1995 | Morton | |
| 5,771,805 | A | 6/1998 | Branas et al. | |
| 5,812,152 | A * | 9/1998 | Torigoe et al. | 347/2 |
| 5,959,718 | A | 9/1999 | Morton | |
| 5,974,967 | A | 11/1999 | Bravenec et al. | |
| 6,133,928 | A * | 10/2000 | Kayashima et al. | 347/171 |
| 6,268,899 | B1 * | 7/2001 | Edwards et al. | 355/22 |
| RE38,065 | E | 4/2003 | Bravenec et al. | |
| 6,709,080 | B2 | 3/2004 | Nims et al. | |
| 2003/0068184 | A1 | 4/2003 | Miyano | |

FOREIGN PATENT DOCUMENTS

| | | | |
|---|---|---|---|
| DE | 44 06 740 | A1 | 9/1995 |
| DE | 199 17 773 | A1 | 11/1999 |
| DE | 100 47 314 | A1 | 4/2001 |
| DE | 102 05 630 | A1 | 8/2003 |
| EP | 0 596 629 | A2 | 5/1994 |
| EP | 1 017 224 | A1 | 7/2000 |

* cited by examiner

*Primary Examiner*—Ren Yan
(74) *Attorney, Agent, or Firm*—Goodwin Procter LLP

(57) ABSTRACT

A method for processing lenticular foil in sheet-fed printing presses is provided, the lenticular foil having lens strips adjacently disposed and extending transversely to the running direction of the sheets. The method ensures that the lens strips proceed parallel to the sheet's front edge For determining the actual position of a sheet aligned according to a front edge, the position of a contact line between two adjacent lens strips is determined, and compared with a nominal position. If the actual position deviates from the nominal position, an adjusting value is generated for realizing a leading or trailing movement of plate cylinders making possible the nominal position, of a gripper sheet-holding system of a sheet-accelerating device mounted in a drum.

8 Claims, 3 Drawing Sheets

METHOD FOR PROCESSING LENTICULAR FOIL

FIELD OF THE INVENTION

The invention relates to a method for processing lenticular foil in sheet-fed printing presses, the lenticular foil having lens strips, which are disposed next to one another and extend transversely to the running direction of the sheets, the sheets of lenticular foil being aligned in the running direction of the sheets as well as transversely to the running direction of the sheets.

BACKGROUND

Lenticular foil, which is also referred to as lens raster foil, is a clear, transparent foil, on the front side of which there is a plurality of curvatures, which are disposed next to one another. The curvatures extend parallel to one another and act as optical lenses. These foils are used to produce lenticular products, for example, for realizing image sequences or three-dimensional image impressions. For this purpose, the back of the lenticular foil is imprinted with a subject. Subsequently, opaque white is applied or the foil is laminated on cardboard.

In order to be able to realize image sequences or three-dimensional image impressions, it is necessary to divide different images into strip-shaped image parts and to combine these sequentially into a single subject. In this connection, each strip sequence of all the images that are to be combined has exactly the same width as a lens strip and must be printed exactly underneath it. Only in this way, depending on the viewing angle selected, does the desired image effect come about, that is, the becoming visible of image sequences or of the 3-dimensional impression of the image. The product is useless if the strip sequences are not printed directly under the lens strip.

In sheet-processing machines, it is generally customary to align the sheets for processing according to their front edge in that these are guided with the front edge against feeding marks. Subsequently, the sheet, which has been aligned according to the front edge, is aligned according to the side edge. For this purpose, the sheet is shifted transversely to its running direction and transported with its side edge against a side stop (DE 100 47 314 A1).

From the DE 102 05 630 A1, it is furthermore known that, after the sheet is aligned in its running direction, the actual position of the side edges is determined by measuring means and compared with the nominal value. If the actual value deviates from the nominal value, a control signal is generated and supplied to a control device. The control device is connected with a gripper system, which is mounted in a feed cylinder so that it can be displaced in the axial direction. The nominal position of the side edge is then realized by shifting the gripper system.

If the sheets of lenticular foil reach the processing stage so that the lens structure extends transversely to the running direction of the sheets and, with that, parallel to the front edge of the sheets, they are aligned according to the front edge at the front marks. Subsequently, they are aligned according to the side edge and afterwards transported in the gripper bite by the sheet-processing machine. Since the front edge of the sheet of lenticular foil does not necessarily always proceed precisely with the lens structure of the lenticular foil, qualitatively bad or useless products cannot be excluded. In addition, it is necessary, by manual adjustment manipulations, to assign the strip sequences accurately to the lens strip. As a result, the productivity of the machine as a whole is also affected disadvantageously.

SUMMARY OF THE INVENTION

It is an object of the invention to develop a method, which ensures that the strip sequences are assigned accurately to the lens strips of the lenticular foil, extending parallel to the front edge.

Pursuant to the invention, the objective is accomplished by a method including: adjusting a front edge of a sheet of lenticular foil having lens strips to a known position on a feeder table of a printing press: sensing a position of a contact line formed between adjacently disposed lens strips; generating a first signal in response to sensing the position of the front edge; generating a second signal in response to sensing the position of the contact line; comparing the first and second signals to determine a correction value corresponding to a misalignment between the contact line and the front edge; feeding the sheet to the plate cylinders; and adjusting a leading or trailing movement of the plate cylinders in accordance with said correction value, thereby aligning the plate cylinders with an actual position of the lens strips.

Due to the inventive method, it is possible to supply sheets of lenticular foil to a sheet-fed printing machine positionally correctly independently of the position of the front edge of the sheet to form the lens structure. With that, the productivity of the plant as a whole and the quality of the lenticular products can be increased.

BRIEF DESCRIPTION OF THE DRAWINGS

The invention is explained in greater detail by means of an example which is described in reference to the drawings.

DETAILED DESCRIPTION

Figure 1:
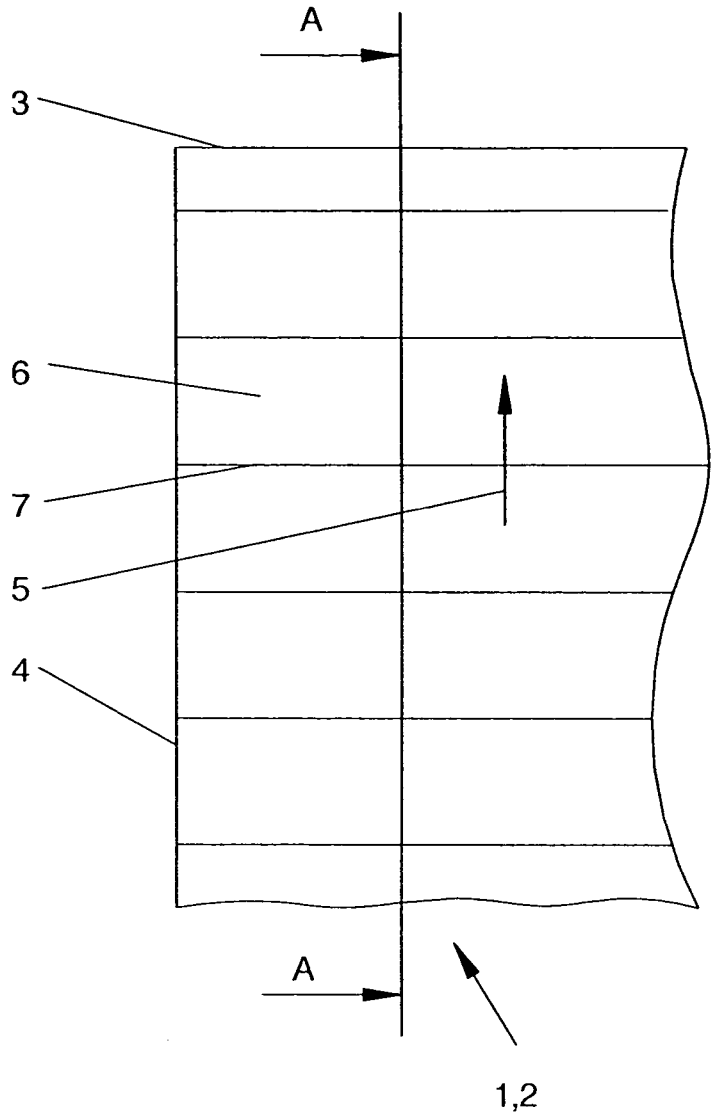
FIG. 1 shows an enlarged representation of a section of a sheet of lenticular foil in plan view.
Figure 2:
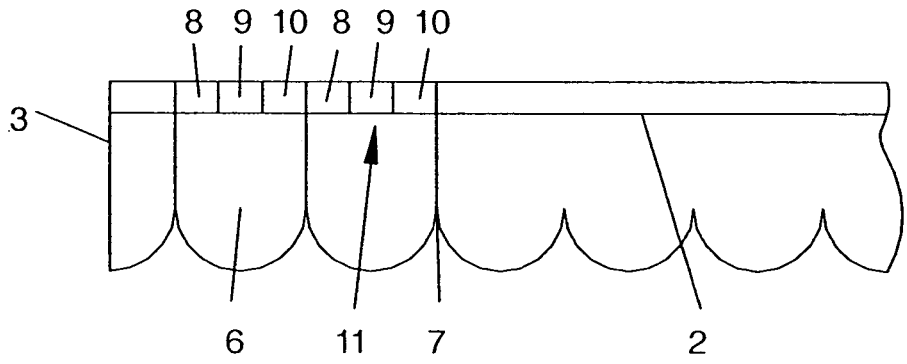
FIG. 2 shows a section through A-A in FIG. 1.

In FIG. 1, the section of a sheet 1, consisting of lenticular foil, is shown with a view of the back side 2. A front edge 3 and a side edge 4 of the sheet 1 are shown. The sheet 1 has lens strips 6, which extend transversely to the running direction 5 of the sheets 1. A contact line 7 is formed in each case by two lens strips 6, which are provided next to one another. In the sectional representation of FIG. 2, it is shown that in each case a first image strip 8, a second image strip 9 and a third image strip to is assigned to each lens strip 6. The image strips 8, 9, 10 represent a strip sequence 11, which must be assigned accurately to the individual lens strips 6. It is shown in FIG. 2 that the front edge 3 is not identical with a contacting line 7.

Figure 3:
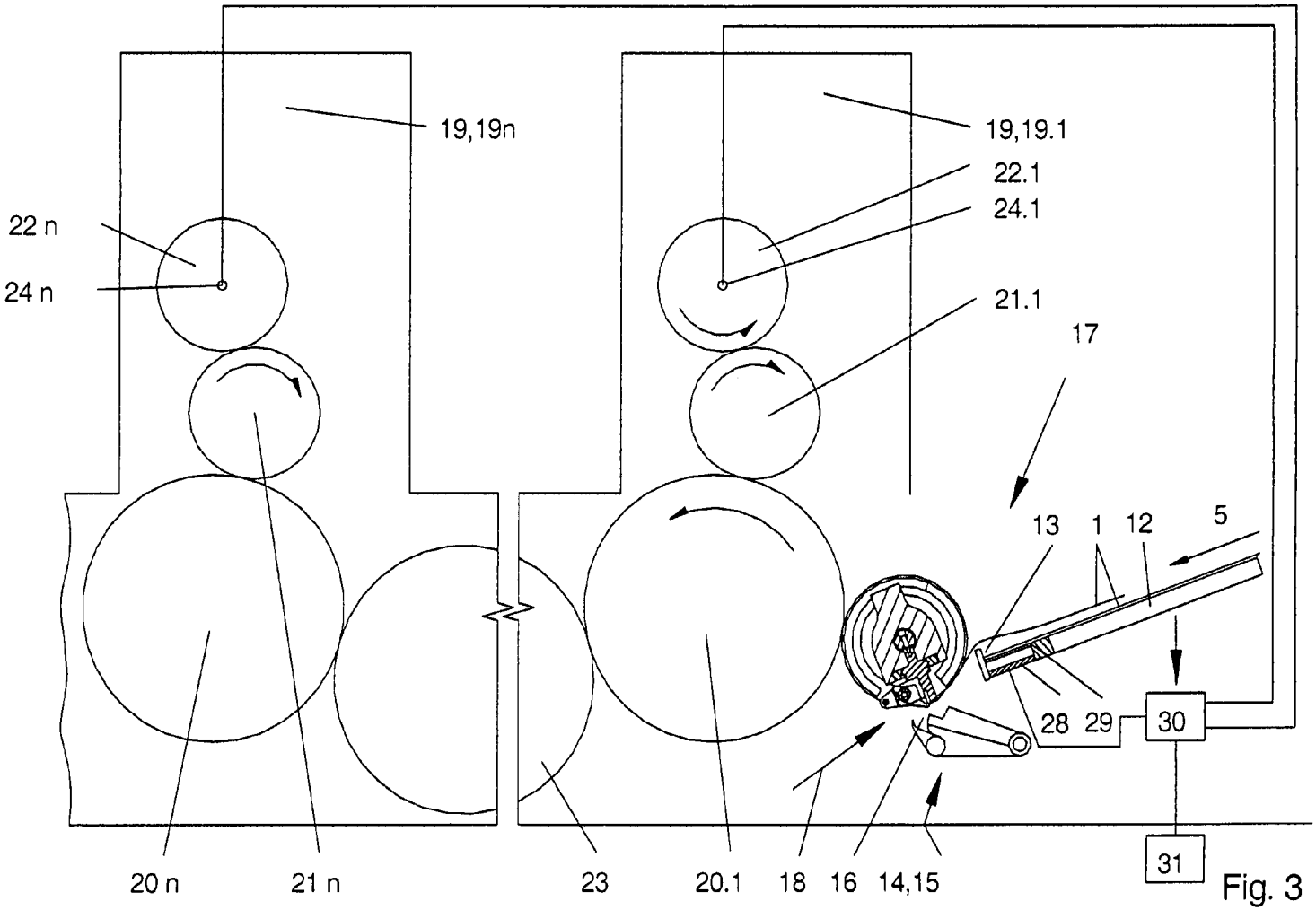
FIG. 3 shows a sheet-feeding apparatus, downstream for which there are printing units.

In FIG. 3, a sheet feeder with a feeder table 12, a sheet-accelerating device 14, which is constructed as a swing feeder 15, and a drum 17 are shown. At the feeder table 12, feeding marks 13 are shown in a working position. They can be brought out of their working position into a position at rest below the feeder table 12. The swing feeder 15 is equipped with a sheet-holding system 16 and the drum 17 is provided with a gripper system 18. Adjoining the drum 17 there are the printing units 19, the drum 17 being disposed directly behind a first printing unit 19.1, adjoining which there may be further printing units 19. In FIG. 3, an nth printing unit **19.*n*** is shown.

Figure 4:
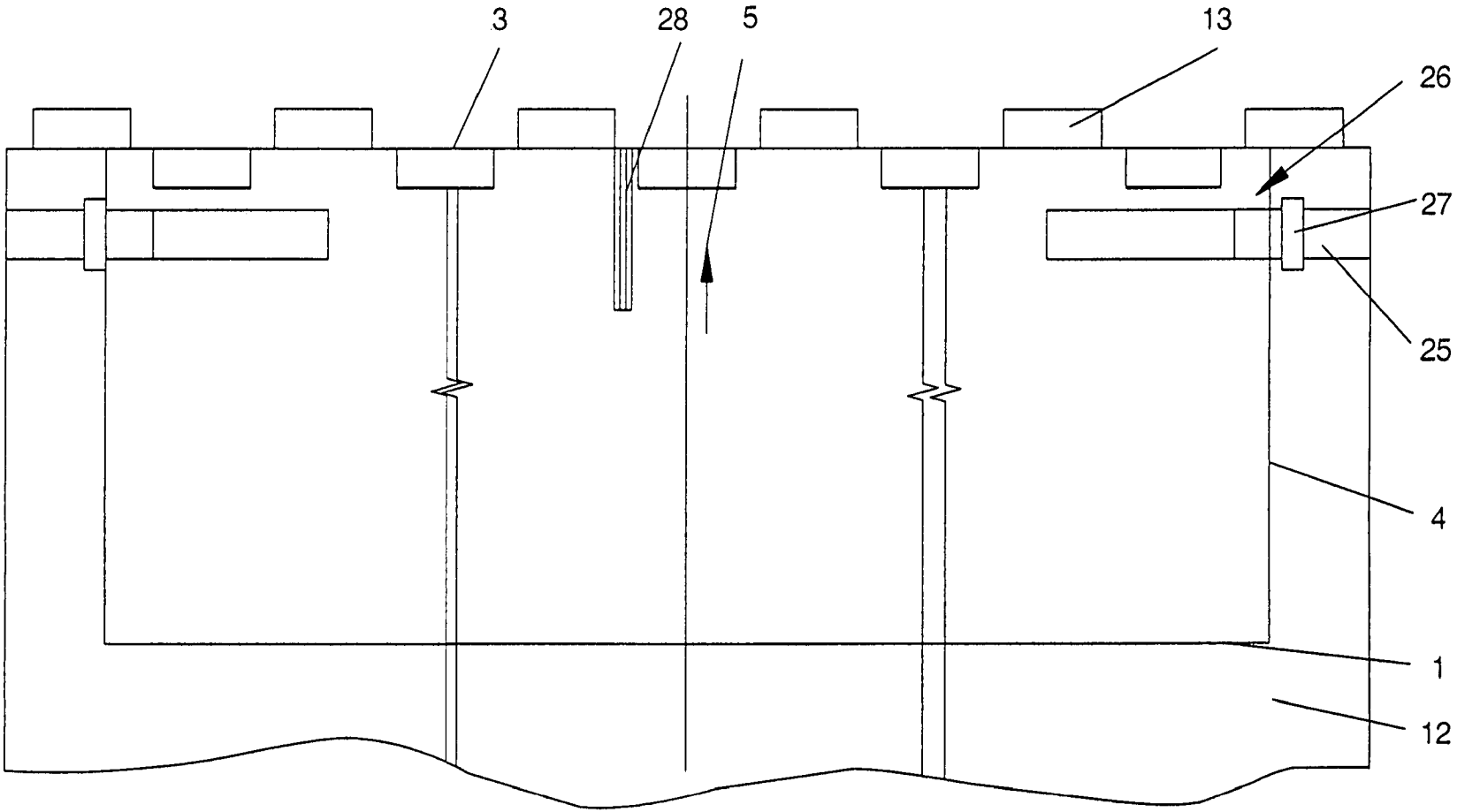
FIG. 4 shows a feeder table in plan view.

The first printing unit 19.1 consists of a first printer cylinder 20.1, to which a first offset cylinder 21.1 is assigned, which is connected with a first plate cylinder 22.1. Correspondingly, the nth printing unit **19.*n* has an nth printing cylinder 20.*n* with an nth offset cylinder 21.*n* and an nth plate cylinder 22.*n*. The printing units 19 are connected by transfer drums 23. A first circumferential register control device 24.1 is assigned to the first plate cylinder 22.1 and an nth circumferential register control device 24.*n* is assigned to the nth plate cylinder 22.*n*. The circumferential register control devices 24.1 to 24.*n* may be constructed as known devices, which can be actuated independently of one another. The circumferential control devices 24.1 to 24.*n* may also be designed so that an individual driving mechanism is assigned at least to the plate cylinders 22.1 to 22.*n*. The individual driving mechanisms can be controlled in such a manner, that they revolve in a leading or trailing manner, by means of which the circumferential register is changed. A sheet 1, held by the gripper system 18, and a sheet 1, lying with the front edge 3 at the feeding marks 13, are shown on the feeder table 12. The feeder table 12 has channels 25, which are disposed transversely to the running direction 5 of the sheets 1 and in which the pull-type side guides 26 are mounted, which have a side stop 27 (FIG. 4). A measuring unit 28 extends in the running direction 5 of the sheet 1 in the feeder table 12. The measuring unit 28 is provided in the feeder table 12 so that the front edge region of the sheet 1, contacting the feeding marks 13, can be detected. For this purpose, the measuring unit 28** in the example is constructed as an optoelectronic measuring unit. However, any other measurement principal can also be used.

The measuring unit 28 is disclosed in a recess extending in the running direction 5 of the sheet 1 in the feeder table 12. The recess is closed off with a transparent covering strip 29, so that the surface of the feeder table 12 and the covering strip 29 form a common plane. The measuring unit 28 is connected with an evaluating and controlling device 30, in which the nominal values can be entered and stored. The evaluating and controlling device 30 is connected with the circumferential register control devices 24.1 to **24.*n* and with a machine-controlling device 31. The sheets 1, consisting of lenticular foil, are transported by a belt table, which is not shown, to the feeder table 12 and with the front edge 3 against the feeding marks 13 positioned in the working position at the feeder table 12 and, with that, aligned according to the front edge 3. The sheet 1, brought to a rest, is taken hold of by the pull-type side guide 26, passed against the side stop 27 and aligned according to the side edge 4. The front edge position of the aligned sheet 1 is determined by the measuring unit 28. At the same time, signals, characterizing the position of the front edge 3 and the position of the adjacent contact lines 7 are generated by the measuring unit 28 and supplied to the evaluating and controlling device 30. In the evaluating and controlling device 30, the signal, generated by the front edge 3 in the measuring unit 28, is gated. In addition, all the signals, which are generated in the measuring unit 28 by the contact lines 7 extending parallel to the front edge 3, are gated out. Only a signal, generated by a contact line 7 is not gated out and used for a nominal/actual comparison in the evaluating and controlling unit 30. In an advantageous manner, the signal is always used for this purpose, which is generated by the contact lines 7, which is adjacent to the front edge 3 of the sheet 1. Any other signal, which is generated by a contact line 7, can also be used. The aligned sheet 1, which is detected with respect to the position of its front edge, is taken over by the sheet-holding system 16 of the swing feeder 15, the feeding marks 13 are brought from their working position into the position at rest and the sheet 1 is transported to the drum 17 and transferred by this to the first printing cylinder 20.1. If a deviation from the nominal position was recorded in the evaluating and controlling device 30 when the nominal value was compared with the actual value, an adjusting value is realized, which corresponds to a correction value, by which the circumferential register control device 24.1 to 24.*n* must adjust the plate cylinders 21.1 to 21.*n*, in order to achieve an exact assignment, starting out from the contact line 7, fixed as the nominal value, of the individual strip sequences 11 to the lens strip 6. Since the adjusting value or correcting value, which was determined for a sheet 1 on the feeder table 12, must be taken into consideration during the transport through each of the printing units 19.1 to 19.*n*, the individual circumferential register control devices 24.1 to 24.*n* are driven synchronously with the passage of a measured sheet 1 with the corresponding adjusting or correcting value. This is realized by the evaluating and controlling device 30, the rotational speed of the machine or the printing speed, converted by the machine control system 31**, being taken into consideration.

Basically, it is possible to align sheets 1 of lenticular foil, detected with respect to the position of their front edge, according to one of the contact lines 7, in that the sheet holding system 16 of the sheet-accelerating device 14 or the gripper system 18 of the drum 17, under the influence of the evaluating and controlling device 30, are driven in a leading or trailing manner by additional regulating units.

What is claimed is:

1. A method for processing sheets of lenticular foil in a sheet-fed printing press, said printing press comprising a feeder table having feeding marks and a side stop, said sheets being fed on said feeder table in a running direction to plate cylinders, said lenticular foil comprising adjacently disposed lens strips that extend transversely to said running direction, the method comprising:

aligning a front edge of a sheet of lenticular foil against said feeding marks and then a side edge of said sheet against said side stop on said feeder table;

sensing a position of said front edge;

sensing a position of a first contact line formed between two adjacently disposed lens strips;

generating a first signal corresponding to said sensed position of said front edge;

generating a second signal corresponding to said sensed position of said first contact line;

comparing said second signal to said first signal to determine an adjusting value corresponding to a deviation of the actual position of said front edge from a nominal position determined by said first contact line; and adjusting a leading or trailing movement of said plate cylinders in accordance with said adjusting value, thereby aligning said plate cylinders with an actual position of said lens strips.

2. The method of claim 1, said printing press comprising circumferential register control devices, said adjusting step further comprising: assigning each of said circumferential register control devices to one of said plate cylinders; determining an associated adjusting value for each of said plate cylinders in accordance with said adjusting value; and synchronously triggering said circumferential register control devices with said associated adjusting values.

3. The method of claim 1, said printing press further comprising a drum adjacent said plate cylinders for receiving said sheet from said feeder table, a gripping system for gripping said sheet onto said drum, said adjusting step further comprising: determining an associated adjusting value for each of said plate cylinders in accordance with said adjusting value; and assigning said associated adjusting values to said gripping system.

4. The method of claim 1, said printing press further comprising a sheet-holding system, said adjusting step further comprising determining an associated adjusting value for each of said plate cylinders in accordance with said adjusting value; and assigning said associated adjusting values to said sheet-holding system.

5. The method of claim 1, said printing press further comprising a measuring unit for sensing said position of said front edge and said position of said control line and generating said first and second signals in the form of pulses, and an evaluating and controlling device, said generating steps comprising generating a first pulse corresponding to said position of said front edge and a second pulse corresponding to said position of said first contact line, said method further comprising supplying said first and second pulses to said evaluating and controlling device for comparing said second signal to said first signal and determining said adjusting value.

6. The method of claim 5, further comprising generating an additional pulse for every contact line formed between each two adjacently disposed lens strips, supplying said additional pulses to said evaluating and controlling device, and filtering out all but said second pulse corresponding to said first contact line.

7. The method of claim 6, wherein said first contact line used in said comparing step to determine said adjusting value is the contact line proximate said front edge.

8. The method of claim 5, said printing press further comprising a machine-controlling device operably connected to said evaluating and control device, said method comprising importing control quantities characterizing the rotational speed or printing speed of said printing press for adjusting said leading or trailing movement of said plate cylinders.

* * * * *